US005197437A

United States Patent [19]

Dahlmann

[11] Patent Number: 5,197,437

[45] Date of Patent: Mar. 30, 1993

[54] FUEL INJECTION APPARATUS FOR AN INTERNAL COMBUSTION ENGINE WITH AN INJECTION PUMP HAVING SEVERAL HIGH-PRESSURE OUTLETS

[75] Inventor: Gerd-Uwe Dahlmann, Braunschweig, Fed. Rep. of Germany

[73] Assignee: Volkswagen AG, Wolfsburg, Fed. Rep. of Germany

[21] Appl. No.: 760,826

[22] Filed: Sep. 17, 1991

Related U.S. Application Data

[63] Continuation of Ser. No. 403,122, Sep. 5, 1989, abandoned.

[30] Foreign Application Priority Data

Sep. 2, 1988 [DE] Fed. Rep. of Germany ..... 3829823

[51] Int. Cl.[5] ..... F02M 41/00

[52] U.S. Cl. ..... 123/467; 123/447; 123/450

[58] Field of Search ..... 123/506, 447, 299, 300, 123/467, 496, 450

[56] References Cited

U.S. PATENT DOCUMENTS

| | | | |
|---|---|---|---|
| 2,810,375 | 10/1957 | Froehlich | 123/447 |
| 3,777,731 | 12/1973 | Kobuyashi | 123/449 |
| 3,965,876 | 10/1976 | Tissot | 123/467 |
| 4,029,071 | 6/1977 | Saito | 123/496 |
| 4,467,767 | 8/1984 | Kampichler | 123/467 |
| 4,648,361 | 3/1987 | Wannenwetsch | 123/506 |
| 4,651,775 | 3/1987 | Filippi | 123/506 |
| 4,711,209 | 12/1987 | Henkel | 123/467 |

FOREIGN PATENT DOCUMENTS 2043914 3/1971 Fed. Rep. of Germany .

*Primary Examiner*—Carl S. Miller

*Attorney, Agent, or Firm*—Brumbaugh, Graves, Donohue & Raymond

[57] ABSTRACT

In the embodiments described in the specification, an injection-quantity adjustment device is coordinated with each high-pressure outlet of an injection pump to equalize the injection quantities of all high pressure outlets. Each injection-quantity adjustment device has a quantity-control piston, an individually selected choke, and an individually arranged spring that acts on the quantity-control piston.

11 Claims, 3 Drawing Sheets

FUEL INJECTION APPARATUS FOR AN INTERNAL COMBUSTION ENGINE WITH AN INJECTION PUMP HAVING SEVERAL HIGH-PRESSURE OUTLETS

This application is a continuation of application Ser. No. 07/403,122, filed on Sep. 5, 1989, now abandoned.

BACKGROUND OF THE INVENTION

This invention relates to fuel injection systems for internal combustion engines with an injection pump having several high-pressure outlets and, more particularly, to a fuel injection system which is arranged to eliminate differences between the quantities of fuel delivered to the various injection valves.

German Offenlegungsschrift No. 20 43 914 discloses a fuel injection apparatus having a pressure regulator, which consists of a piston working against a spring. This prior art apparatus adjusts, depending on the pressure, the injection quantity, which is the amount of fuel delivered to injection valves, by redirecting a portion of the fuel to a fuel container. However, this prior art apparatus does not coordinate the adjustment of the injection quantity with the individual high-pressure outlets of an injection pump.

SUMMARY OF THE INVENTION

Accordingly, it is an object of the present invention to provide a fuel injection apparatus for an internal combustion engine with an injection pump having several high-pressure outlets which overcomes the above-mentioned disadvantage of the prior art.

Another object of the invention is to provide a fuel injection apparatus of the above character which eliminates differences among the injection quantities of the individual injection valves.

These and other objects of the invention are attained by providing a fuel injection apparatus for an internal combustion engine with an injection pump having several high-pressure outlets, which apparatus equalizes the injection quantities delivered to all the injection valves by individual adjustment of injection-quantity adjustment devices, which are coordinated with the individual high-pressure outlets of the injection pump and, hence, the injection valves. The invention equalizes the injection quantities of all the injection valves, regardless of the specific causes of the differences among the injection quantities.

In one embodiment of the invention, the pressure valve and the injection-quantity adjustment device are constructed as separate units and they are screwed into different recesses in the injection pump housing, the adjustment device having a choke, a quantity-control piston, a pressure chamber, a compression spring, and a stop. When the pressure in the high-pressure outlet of the injection pump increases, the quantity-control piston slides to enlarge the pressure chamber, thereby reducing the pressure. The sliding of the quantity-control piston and, hence, the maximum volume of the pressure chamber, are limited by the stop, the axial position of which is determined by an adjustment spindle Since each of the high-pressure outlets is coordinated with an injection-quantity adjustment device, the injection quantities can be adjusted to a predetermined value for each injection valve. The size of the pressure chamber or the pressure inside the pressure chamber can be influenced by the design of the choke and the characteristic curve or the pre-tension of the compression spring, thereby facilitating adjustment of the injection quantities throughout the entire operating range of engine speeds.

In another embodiment of the invention, the pressure valve and the injection-quantity adjustment device are combined in one assembly that is screwed into a single recess in the injection pump housing. The pressure valve has the same construction as the pressure valve in the first embodiment. In this embodiment, however, operation of the adjustment device depends on the fuel pressure at the outlet of the pressure valve.

In yet another embodiment of the present invention, individual components of the pressure valve and the injection-quantity adjustment device are combined in a single assembly. This embodiment minimizes the cost for the assembly.

BRIEF DESCRIPTION OF THE DRAWINGS

Further objects and advantages of the invention will be apparent from a reading of the following description in conjunction with the accompanying drawings, in which.

DESCRIPTION OF THE PREFERRED EMBODIMENTS

Figure 1:
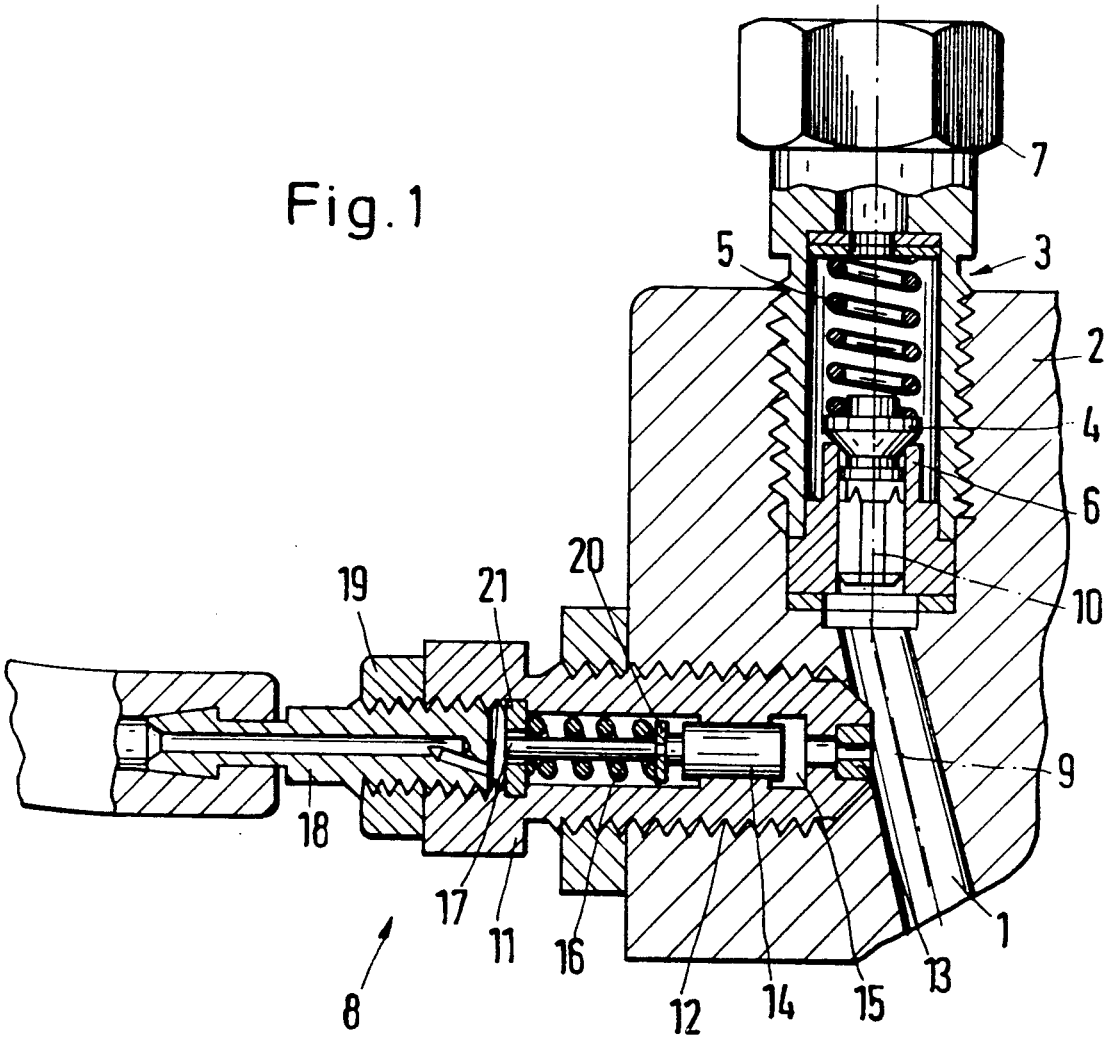
FIG. 1 is a schematic sectional view showing a representative embodiment of a fuel injection apparatus for an internal combustion engine with an injection pump having several high-pressure outlets, wherein the pressure valve and the injection-quantity adjustment device are constructed as separate units in accordance with the invention.

The representative embodiment of the invention schematically shown in FIG. 1 has several high-pressure outlets from a fuel injection pump, the design of which is well known and does not require description. Only one of the high-pressure outlets, 1, is shown in the drawing, along with the injection pump housing 2. The high-pressure outlet 1 leads, via a pressure valve 3 composed of a valve body 4, a locking spring 5, and a valve seat 6, to a fuel line, not illustrated, which can be connected to the pressure valve 3 by a union nut 7. The fuel line, in turn, leads to a fuel injection valve, the design of which is well known and does not require description. When the fuel pressure is sufficiently high, the injection valve opens and injects a predetermined quantity of fuel.

The high-pressure outlet 1 is connected also to an injection-quantity adjustment device 8. In the embodiment illustrated in FIG. 1, the injection-quantity adjustment device 8 has an axis 9 positioned perpendicular to an axis 10 of the pressure valve 3. The injection-quantity adjustment device 8 includes a basic body 11, which has holes of various diameters to hold the working parts of the adjustment device, and an external thread 12 for screw-in insertion into the injection pump housing 2.

The working parts of the illustrated adjustment device include a choke 13 adjacent to the high-pressure outlet 1, a quantity-control piston 14, a compression spring 16, and a stop 17. The quantity-control piston 14, which is housed in the basic body 11 and aligned with the axis 9 to facilitate sliding, combines with the choke 13 to form a variable-size pressure chamber 15. The compression spring 16 tends to reduce the size of the pressure chamber 15 by urging the quantity-adjustment piston 14 against the fuel pressure. The maximum size of the pressure chamber 15 is limited by the stop 17 which restricts the leftward motion of the quantity-control piston 14 and the limiting axial position of the stop 17 can be altered by manipulating an adjustment spindle 18, the position of which is maintained by a lock nut 19.

As shown in FIG. 1, the compression spring 16 is clamped between a spring plate 20 mounted on the quantity-control piston 14 and a spring pre-tension disc 21, having the form of a ring secured in the basic body 11.

When the fuel pressure in the high-pressure outlet 1 increases, the quantity-control piston 14 in FIG. 1 slides leftward to enlarge the pressure chamber 15, thereby reducing the fuel pressure. The size of the pressure chamber 15 or the pressure inside the pressure chamber can be influenced by the design of the choke 13 and the characteristic curve or the pre-tension of the compression spring 16. Since each of the high-pressure outlets from the fuel pump is provided with an injection-quantity adjustment device 8, the injection quantities can be adjusted to a predetermined value for each injection valve.

As previously mentioned, the leftward sliding of the quantity-control piston 14 in FIG. 1 and, hence, the maximum volume of the pressure chamber 15, is limited by the stop 17. Consequently, it is possible to individually control the injection quantity of the high-pressure outlet 1 by manipulating the adjustment spindle 18, which alters the axial position of the stop 17.

Figure 2:
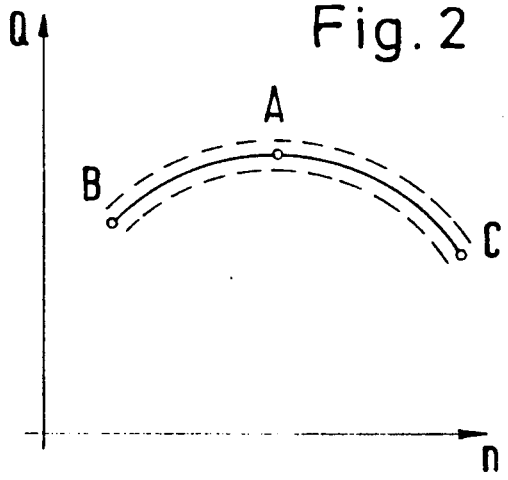
FIG. 2 is an on-load speed diagram, representing the relationship between the load "Q" and the r.p.m. "n" of an internal combustion engine, which diagram is used in conjunction with explaining the layout of various components of the injection-quantity adjustment device in accordance with the invention.

Generally, however, the above-described quantity adjustment applies only to one point in the on-load speed diagram, namely the point A in FIG. 2, which figure represents the relationship between the load "Q" and the r.p.m. "n" of the internal combustion engine. To facilitate the control of the injection quantity by the use of the adjustment device 8 also in the higher r.p.m. range, i.e., from the point A to the point C in FIG. 2, and in the lower r.p.m. range, i.e., from the point B to the point A, the adjustment device 8 incorporates three additional adjustment elements: the choke 13, the pressure spring 16, and the spring pre-tension disc 21. By the use of these three additional elements, the injection quantities of the individual high-pressure outlets are equalized throughout the entire engine-speed range of the internal combustion engine.

The choke 13 is arranged so that it is inoperable in the lower speed range between points A and B in FIG. 2. However, in the high speed range between points A and C, the choke 13 limits the flow of fuel to the pressure chamber 15. By the use of the choke 13 with an appropriate flow rate, equalization of the injection quantities of the various high-pressure outlets is possible even in the high speed range between points A and C in FIG. 2.

To facilitate equalization of the injection quantities of the various high-pressure outlets, the compression springs 16 with various spring constants and/or various pre-tensions are installed in the injection-quantity adjustment devices 8, which are coordinated with the various high-pressure outlets. The spring pre-tension discs 21 of various thicknesses are used to adjust the pre-tension.

By the use of the compression spring 16 and the spring pre-tension disc 21, at a low r.p.m., at which the injection pressures are low and the injection pressure gradients are flatter, it is possible to delay the start of the leftward movement of the quantity-control piston 14.

The above-described connections and control possibilities, explained in conjunction with FIG. 2, are valid also for other embodiments of the invention, which will be explained in conjunction with FIGS. 2 and 3.

In the embodiment shown in FIG. 1, the pressure valve 3 and the quantity adjustment device 8 ar constructed as separate units, and they are screwed into different recesses in the injection pump housing 2. Contrastingly, FIG. 3 shows an embodiment of the present invention which combines a pressure valve 30 and an injection-quantity adjustment device 31 in one assembly that is screwed into a single recess in an injection pump housing 32 to receive fuel from a high-pressure outlet 33 in the housing.

A union nut 35, which has a screw thread 34, holds three basic body parts 36, 37, and 38 together, at least when the unit is installed. These basic body parts and the union nut 35 have axial recesses or holes of various diameters in alignment with one another. The axial recesses hold the working parts of the pressure valve 30 and the injection-quantity adjustment device 31. In addition, the various parts also contain holes to form, when aligned sequentially, a fuel-delivery channel 39, which empties into a fuel line, not shown, connected to an outlet 40. The fuel line, in turn, leads to the relevant injection valve.

The fuel-delivery channel 39 passes through the injection-quantity adjustment device 31 which includes a choke 41 adjacent to the pressure valve 30, a slidable quantity-control piston 42, a pressure chamber 43 between the choke 41 and the piston 42, a compression spring 44, and a stop 46, the axial position of which can be adjusted by the manipulation of an adjustment screw 45. A seal 47 is provided in an axial channel leading to the adjustment screw. Thus, the injection-quantity adjustment device 31 interacts with the fuel pressure only through a channel 48 which is connected with the outlet of the pressure valve 30.

Figure 3:
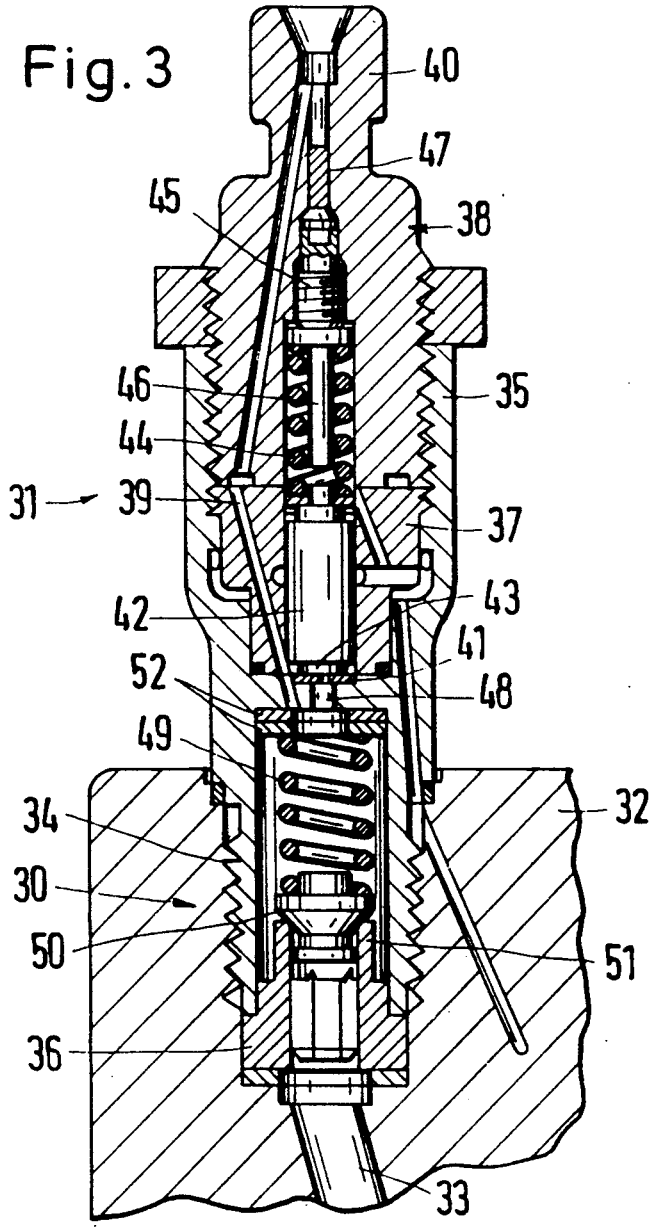
FIG. 3 is a schematic sectional view showing a representative embodiment of a fuel injection apparatus for an internal combustion engine with an injection pump having several high-pressure outlets, wherein the pressure valve and the injection-quantity adjustment device are combined in a single assembly in accordance with the invention.

The pressure valve 30 in FIG. 3 has the same construction as the pressure valve in FIG. 1 including a piston 50, which is pushed by the fuel pressure against the restoring force of a compression spring 49 and rises from its valve seat 51, and two discs 52 for adjusting the spring pretension.

In the embodiment shown in FIG. 3, operation of the adjustment device 31 depends on the fuel pressure at the outlet of the pressure valve 30. Through axial sliding of the quantity-control piston 42 and, accordingly, control of the volume of the pressure chamber 43, with the use of the appropriately arranged choke 41 and spring 44 according to the on-load speed diagram in FIG. 2, predetermined injection quantities can be delivered to the several valves over the entire engine-speed range of the internal combustion engine.

Figure 4:
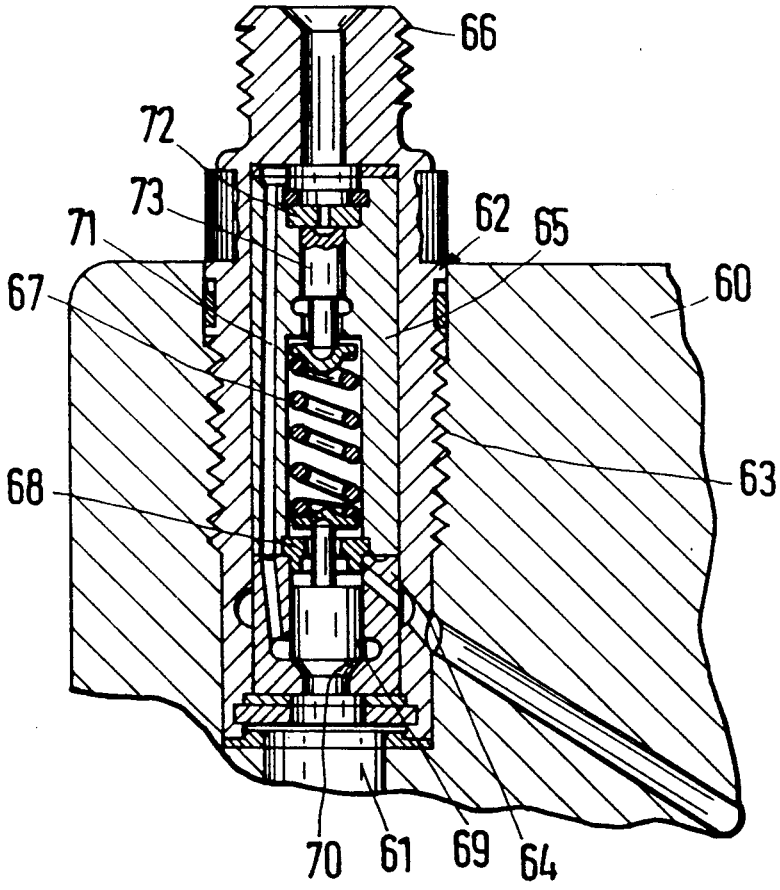
FIG. 4 is a schematic sectional view showing a representative embodiment of a fuel injection apparatus for an internal combustion engine with an injection pump having several high-pressure outlets, wherein the individual components of the pressure valve and the injection-quantity adjustment device are combined in a single assembly in accordance with the invention.

FIG. 4 shows another embodiment of the present invention, in which the cost for the assembly of the pressure valve and the injection-quantity adjustment device is minimized. This assembly, which is an extension of a high-pressure outlet 61, is screwed into a recess of a pump housing 60. The assembly contains two basic body parts 64 and 65, which are held together by a cap 62 having a screw thread 63. At the end of the cap 62 which lies outside the pump housing 60, the cap has a screw connection 66 for a fuel line, not shown, that leads to the injection valve.

The pressure valve contains a valve body 69 that can be pushed axially by the fuel pressure against the force of a compression spring 67 and a stop 68 that limits the movement of the valve body 69. After the valve body 69 separates from its valve seat 70, it creates an opening for the fuel to flow to a delivery channel 71. The delivery channel leads to the connection 66 and, subsequently, to an inlet of an injection-quantity adjustment device.

The injection-quantity adjustment device contains a choke 72, a quantity-control piston 73, and a spring 67. The spring 67, which is combined in a single assembly with the quantity-control piston 73 and the valve body 69 of the pressure valve, acts to push the quantity-control piston 73 towards the choke 72 to reduce the size of the pressure chamber.

Although the invention has been described herein with reference to specific embodiments, many modifications and variations therein will readily occur to those skilled in the art. Accordingly, all such variations and modifications are included within the intended scope of the invention.

I claim:

1. A fuel injection apparatus for an internal combustion engine comprising an injection pump common to a plurality of fuel injection valves and having a plurality of high-pressure outlets, each connected to one of the fuel injection valves through flow passages providing different fuel flow characteristics, and a plurality of individually adjustable volumetric injection-quantity adjustment devices, each of which includes individually selectable choke means and is connected to one of the high-pressure outlets of the injection pump in the downstream direction therefrom and is selectively adjustable in accordance with the flow characteristics of the corresponding fuel flow passage to compensate for different characteristics of the flow paths and provide the same fuel volume for injection in response to the same type of injection pump operation.

2. A fuel injection apparatus according to claim 1 wherein each injection-quantity adjustment device has a quantity-control piston, a choke disposed between the quantity-control piston and the corresponding high-pressure outlet, the piston and the choke forming a pressure chamber, and spring means urging the quantity-control piston in the direction to reduce the size of the pressure chamber.

3. A fuel injection apparatus according to claim 2, including an adjustable stop which limits the motion of the quantity-control piston in the direction to enlarge the size of the pressure chamber.

4. A fuel injection apparatus according to claim 2 or claim 3 wherein the choke is designed to limit fuel flow only in a high engine-speed range of the internal combustion engine.

5. A fuel injection apparatus according to claim 4 including a plurality of spring means with various characteristics for corresponding injection-quantity adjustment devices, permitting equalization of the injection quantities at medium and low speeds of the internal combustion engine.

6. A fuel injection apparatus according to claim 1 wherein the injection-quantity adjustment devices are at least partially integrated in a housing of the injection pump.

7. A fuel injection apparatus according to claim 1 wherein each injection-quantity adjustment device forms an independent assembly.

8. A fuel injection apparatus according to claim 6 wherein at least one injection-quantity adjustment device is combined with a pressure valve of one of the high-pressure outlets in an individual assembly.

9. A fuel injection apparatus according to claim 8 wherein the assembly includes an inlet to the injection-quantity adjustment device and at least one fuel-delivery channel bypassing the injection-quantity adjustment device, said inlet and said channel being connected to the pressure valve on the outlet side.

10. A fuel injection apparatus according to claim 8 wherein the pressure valve contains a valve body, which is positioned in the assembly in such a manner that the valve body can move axially, and the injection-quantity adjustment device contains a quantity-control piston, which is positioned in the assembly in such a manner that the piston can move axially and which, together with the choke, forms a pressure chamber, the piston and the valve body enclosing a compression spring, the compression spring tending to close the pressure valve or push the quantity-control piston so as to decrease the size of the pressure chamber, with at least one fuel-delivery channel, originating at the outlet of the pressure valve, being connected with the inlet of the injection-quantity adjustment device, said inlet being turned away from the pressure valve.

11. A fuel injection apparatus according to claim 9 or claim 10 wherein the assembly includes a plurality of components of a body sequentially aligned along the longitudinal axis and held together by a threaded cap, and the components are provided with axial recesses aligned with one another to receive parts of the pressure valve and the injection-quantity adjustment device and have off-center sectional channels to form a delivery channel, and are arranged to facilitate insertion of the parts before connecting the parts to form the body.

* * * * *